United States Patent [19]

Boon

[11] 4,456,403

[45] Jun. 26, 1984

[54] DEVICE FOR ABSORBING HORIZONTALLY DIRECTED IMPACTS ON THE SUPPORT LEGS OF AN ARTIFICIAL ISLAND DURING LOWERING AND LIFTING OF THE LEGS RESPECTIVELY

[75] Inventor: Bart Boon, Schiedam, Netherlands

[73] Assignee: RSV-Gusto Engineering B.V., Netherlands

[21] Appl. No.: 298,801

[22] Filed: Sep. 2, 1981

[30] Foreign Application Priority Data

Sep. 4, 1980 [NL] Netherlands ..... 8005011

[51] Int. Cl.[3] ..... E02B 17/08; E02D 31/00

[52] U.S. Cl. ..... 405/196; 405/211

[58] Field of Search ..... 405/205, 208, 211, 224, 405/171, 172, 203, 196

[56] References Cited

U.S. PATENT DOCUMENTS

| | | | |
|---|---|---|---|
| 1,008,669 | 11/1911 | Nixon | 405/211 |
| 3,394,553 | 7/1968 | Vidal | 405/224 X |
| 3,916,633 | 11/1975 | Lovie et al. | 405/224 X |
| 3,919,957 | 11/1975 | Ray et al. | 405/224 X |
| 4,145,909 | 3/1979 | Daughtry | 405/171 |
| 4,279,545 | 7/1981 | de Werk | 405/211 |

*Primary Examiner*—Cornelius J. Husar
*Assistant Examiner*—Nancy J. Stodola

[57] ABSTRACT

Device for absorbing horizontally directed impact loads on the supporting legs of an artificial island comprising a pontoon and legs that are movable in the vertical direction and can be locked when the legs are lowered or lifted respectively further comprising energy absorbing and/or transfering means (2) extending downwardly from the lower part (1) of each of the legs.

2 Claims, 1 Drawing Figure

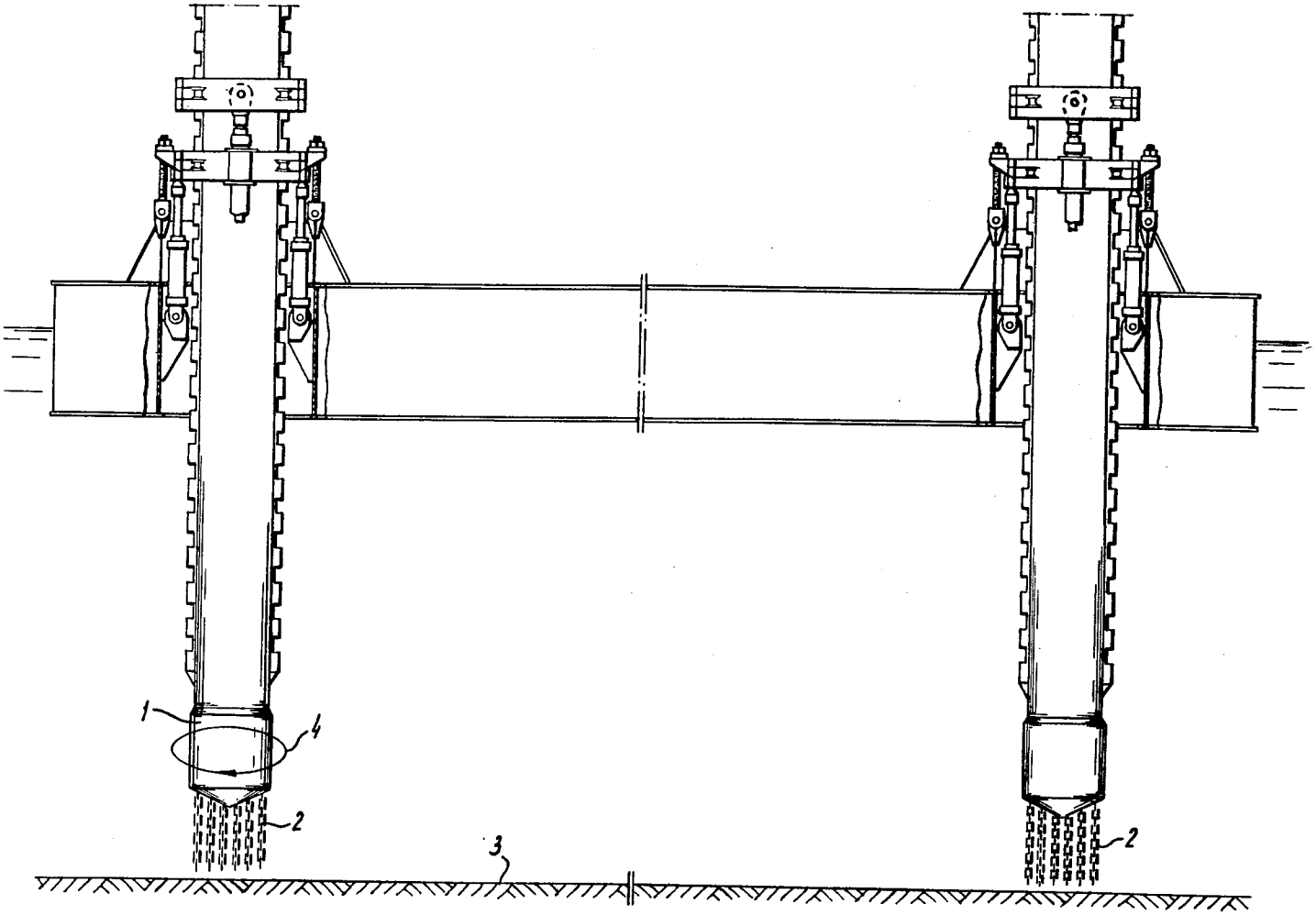
2
3
4
2
1

DEVICE FOR ABSORBING HORIZONTALLY DIRECTED IMPACTS ON THE SUPPORT LEGS OF AN ARTIFICIAL ISLAND DURING LOWERING AND LIFTING OF THE LEGS RESPECTIVELY

The invention is related to a device for absorbing horizontally directed impact loads on the supporting legs of an artificial island comprising a pontoon and legs that are movable in the vertical direction and can be locked when the legs are lowered or lifted, respectively. In the case of artificial islands in particular, as a result of undulatory motions, problems arise in case the support legs are lowered or lifted. During bad weather these movements are large. In the event of such orbital movement, the lower end of the leg rotates according to a spatial curve and the danger is that in that case said lower end touches the ground or is dragged therealong, respectively, as result of the horizontally directed component of this movement. Until now no suitable solution has been found in particular with regard to the problem of the horizontally directed movement.

Consequently, the invention aims to provide a simple and cheap solution and according to the invention this aim is obtained by the fact that said device comprises energy absorbing and/or transferring means extending downwardly from the lower part of each of the legs.

These energy absorbing and/or transferring means comprise chains that can drag along the ground and act as a brake or comprise deformable means that are deformed when in contact with the ground and thus absorb energy and transfer a part of it to the ground.

At the lower end of the leg a plurality of chains can be suspended, and in case the lower end of the leg near the ground performs a horizontal movement along it, the chains drag over the ground and slow down said movement. If necessary the legs can be provided with means such as anchor pins that increase the friction. The effect is based partly on the friction exerted on the bottom of the sea on which the chains are held and consequently absorb the movement, but also on the weight of the chains for these have to be lifted again during parts of said orbital movement.

It is not important whether the chains of parts of them get lost. In case deformable means are applied, such as downwardly directed beams, these also get lost.

This device for absorbing horizontally directed movements can be combined with the apron that is the subject of the Dutch patent application 8005012 filed on the same day and which is the same as U.S. application No. 298,803.

By combining both, all movements of the foot of the leg near the ground can be absorbed.

The single FIGURE of the drawing shows an embodiment given by way of example of a pontoon having supporting legs according to the invention.

The drawing shows the lower end 1 of supporting legs for a pontoon on which a plurality of heavy chains 2 are mounted. The supporting legs are shown as being movable in the vertical direction with respect to the pontoon and can be locked with respect to the pontoon when the legs are lowered upon the sea bottom 3. During lowering or lifting of the legs these perform near the ground 3 an orbital movement as indicated by 4. The chains 2 touching the ground absorb these movements.

I claim:

1. Device for absorbing horizontally directed impact loads on supporting legs of an artificial island comprising a pontoon and legs that are movable in a vertical direction with respect to the pontoon and can be locked with respect to the pontoon when the legs are lowered upon a sea bottom, said legs being able to be lifted as well and being provided with means for damping the horizontal movements of lower ends of the legs due to movements of the pontoon when the legs approach the sea bottom, characterized in that said means comprise heavy chains which each have one end thereof attached to the lowermost end of each of the legs and another end thereof free and located beneath the lowermost end of each of the legs so the chains extend downwardly from the lowermost end of each of the legs a substantial distance beyond the lowermost end of each of the legs to absorb energy by touching the sea bottom and being dragged thereover in a horizontal direction prior to the lower end of the legs touching the sea bottom.

2. Device for absorbing horizontally directed impact loads on supporting legs of an artificial island comprising a pontoon and legs that are movable in a vertical direction with respect to the pontoon and can be locked with respect to the pontoon when the legs are lowered upon a sea bottom, said legs being able to be lifted as well and being provided with means for damping the horizontal movements of lower ends of the legs due to movements of the pontoon when the legs approach the sea bottom, characterized in that said means comprise deformable means which have one end thereof attached to the lowermost end of each of the legs and another end thereof free and located beneath the lowermost end of each of the legs so the deformable means extend downwardly from a lowermost part of each of the legs a substantial distance beyond the lowermost end of each of the legs to absorb energy by touching the sea bottom and being dragged thereover in a horizontal direction prior to the lower ends of the legs touching the sea bottom.

* * * * *